US010519835B2

(12) United States Patent
Kang

(10) Patent No.: US 10,519,835 B2
(45) Date of Patent: Dec. 31, 2019

(54) METHOD AND APPARATUS FOR CONTROLLING A SINGLE-SHAFT DUAL EXPANSION INTERNAL COMBUSTION ENGINE

(71) Applicant: GM GLOBAL TECHNOLOGY OPERATIONS LLC, Detroit, MI (US)

(72) Inventor: Jun-mo Kang, Ann Arbor, MI (US)

(73) Assignee: GM Global Technology Operations LLC., Detroit, MI (US)

( * ) Notice: Subject to any disclaimer, the term of this patent is extended or adjusted under 35 U.S.C. 154(b) by 228 days.

(21) Appl. No.: 15/836,197

(22) Filed: Dec. 8, 2017

(65) Prior Publication Data

US 2019/0178137 A1 Jun. 13, 2019

(51) Int. Cl.

| | |
|---|---|
| ***F01N 3/22*** | (2006.01) |
| ***F02B 75/18*** | (2006.01) |
| ***F02B 75/32*** | (2006.01) |
| ***F01N 13/08*** | (2010.01) |

(52) U.S. Cl.

CPC ..... *F01N 3/222* (2013.01); *F01N 13/087* (2013.01); *F02B 75/18* (2013.01); *F02B 75/32* (2013.01); *F01N 2410/14* (2013.01); *F02B 2075/1812* (2013.01)

(58) Field of Classification Search

CPC .... F01N 3/222; F01N 13/087; F01N 2410/14; F02B 75/18; F02B 75/32; F02B 2075/1812

USPC ..... 701/101

See application file for complete search history.

(56) References Cited

U.S. PATENT DOCUMENTS

| | | | | |
|---|---|---|---|---|
| 4,202,300 | A * | 5/1980 | Skay | F02B 33/22 123/432 |
| 6,553,977 | B2 * | 4/2003 | Schmitz | F02B 41/06 123/561 |
| 7,201,156 | B1 * | 4/2007 | Wait | F01L 1/28 123/556 |
| 8,813,695 | B2 * | 8/2014 | Meldolesi | F02B 21/00 123/52.1 |
| 9,080,508 | B2 * | 7/2015 | Durrett | F02B 75/04 |
| 9,297,295 | B2 * | 3/2016 | Scuderi | F02B 21/00 |
| 9,574,491 | B2 * | 2/2017 | Durrett | F02B 41/06 |
| 9,677,464 | B2 * | 6/2017 | Durrett | F01B 9/02 |
| 9,897,000 | B2 * | 2/2018 | Durrett | F02B 41/08 |
| 2002/0050253 | A1 * | 5/2002 | Schmitz | F02B 41/06 123/64 |

(Continued)

*Primary Examiner* — David Hamaoui
*Assistant Examiner* — John D Bailey
(74) *Attorney, Agent, or Firm* — Quinn IP Law

(57) ABSTRACT

An internal combustion engine includes first and second power cylinders and an expander cylinder, and is configured to operate in an expander mode and a bypass mode by selectively fluidly coupling exhaust flow from the first and second power cylinders to the expander cylinder. Operation includes commanding a transition from the bypass mode to the expander mode, including retarding openings of intake valves of the first and second power cylinders to a LIVC position. Exhaust valves of the power cylinders are controlled to effect fluid flow to the expander cylinder, and opening of an outlet valve of the expander cylinder is controlled to a maximum advanced state. The openings of the intake valves of the first and second power cylinders are controlled to desired positions associated with engine operation in the expander mode.

16 Claims, 2 Drawing Sheets

(56) References Cited

U.S. PATENT DOCUMENTS

2004/0255882 A1* 12/2004 Branyon ..... F02B 33/22 123/70 R
2007/0289562 A1* 12/2007 Zajac ..... F02B 41/02 123/51 R
2009/0039300 A1* 2/2009 Meldolesi ..... F01L 1/465 251/57
2009/0056331 A1* 3/2009 Zhao ..... F02B 41/06 60/524
2009/0056670 A1* 3/2009 Zhao ..... F02B 41/06 123/25 P
2009/0301086 A1* 12/2009 Ralston ..... F02B 41/06 60/620
2010/0018479 A1* 1/2010 Hu ..... F02B 41/06 123/58.1
2010/0095927 A1* 4/2010 Salminen ..... F01B 7/18 123/254
2010/0282225 A1* 11/2010 Gilbert ..... F01L 9/026 123/70 R
2010/0300385 A1* 12/2010 Durrett ..... F02B 41/06 123/64
2011/0094462 A1* 4/2011 Durrett ..... F02B 47/10 123/58.1
2011/0220078 A1* 9/2011 Meldolesi ..... F02B 33/22 123/70 R
2011/0303185 A1* 12/2011 Zajac ..... F02B 41/06 123/275
2012/0073551 A1* 3/2012 Branyon ..... F02B 33/22 123/70 R
2012/0125282 A1* 5/2012 Hayman ..... F01N 13/107 123/193.5
2012/0298086 A1* 11/2012 Scuderi ..... F02B 33/22 123/70 R
2013/0298552 A1* 11/2013 Branyon ..... F02B 37/00 60/605.2
2014/0090615 A1* 4/2014 Mistry ..... F02B 33/22 123/90.17
2014/0123958 A1* 5/2014 Durrett ..... F02B 41/08 123/48 R
2014/0261325 A1* 9/2014 Scuderi ..... F02B 21/00 123/445
2014/0338646 A1* 11/2014 Tour ..... F02B 33/18 123/70 R
2015/0315959 A1* 11/2015 Tour ..... F01L 1/46 123/70 R
2016/0222877 A1* 8/2016 Durrett ..... F02B 41/06
2016/0363045 A1* 12/2016 Durrett ..... F01B 9/02
2018/0266308 A1* 9/2018 Tour ..... F02B 33/22

* cited by examiner

METHOD AND APPARATUS FOR CONTROLLING A SINGLE-SHAFT DUAL EXPANSION INTERNAL COMBUSTION ENGINE

INTRODUCTION

A single-shaft dual expansion internal combustion engine includes an engine block having first and second power cylinders and an expander cylinder. Power pistons reciprocate in the power cylinders and connect to crankpins of the crankshaft, and an expander piston reciprocates in the expander cylinder. A multi-link connecting rod assembly may mechanically couple the expander piston to another crankpin of the crankshaft. Flow of air and combustion gases between an intake manifold, the power cylinders, the expander cylinder and the exhaust manifold occurs through a cylinder head.

SUMMARY

An internal combustion engine is described, and includes first and second power cylinders and an expander cylinder. The internal combustion engine is configured to operate in an expander mode, including exhaust flow from the first and second power cylinders being fluidly coupled to the expander cylinder. The internal combustion engine is configured to operate in a bypass mode, including exhaust flow from the first and second power cylinders being fluidly decoupled from the expander cylinder. The method includes commanding a transition from the bypass mode to the expander mode during engine operation, including retarding openings of intake valves of the first and second power cylinders to a Late Intake Valve Closing ("LIVC") position. Exhaust valves of the power cylinders are controlled to effect fluid flow to the expander cylinder, and opening of an outlet valve of the expander cylinder is controlled to a maximum advanced state. The openings of the intake valves of the first and second power cylinders are controlled to desired positions associated with engine operation in the expander mode.

An aspect of the disclosure includes controlling exhaust valves of the power cylinders to effect fluid flow to the expander cylinder by activating first exhaust valves associated with the first and second power cylinders to couple fluid flow to the expander cylinder and deactivating second exhaust valves associated with the first and second power cylinders to decouple fluid flow to an exhaust manifold.

An aspect of the disclosure includes commanding a transition from the expander mode to the bypass mode during engine operation, including retarding openings of the intake valves of the first and second power cylinders to the LIVC position, and retarding the outlet valve of the expander cylinder to a maximum retarded state. The exhaust valves of the power cylinders are controlled to discontinue fluid flow to the expander cylinder, and the openings of the intake valves of the first and second power cylinders are controlled to desired positions associated with engine operation in the bypass mode.

Another aspect of the disclosure includes controlling exhaust valves of the power cylinders to discontinue fluid flow to the expander cylinder, including deactivating first exhaust valves associated with the first and second power cylinders to decouple fluid flow to the expander cylinder and activating second exhaust valves associated with the first and second power cylinders to couple fluid flow to an exhaust manifold.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

It should be understood that the appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the drawings are in simplified form and are not to precise scale. Furthermore, the disclosure, as illustrated and described herein, may be practiced in the absence of an element that is not specifically disclosed herein. As employed herein, the term "upstream" and related terms refer to elements that are towards an origination of a flow stream relative to an indicated location, and the term "downstream" and related terms refer to elements that are away from an origination of a flow stream relative to an indicated location. These and similar directional terms are not to be construed to limit the scope of the disclosure.

Figure 1:
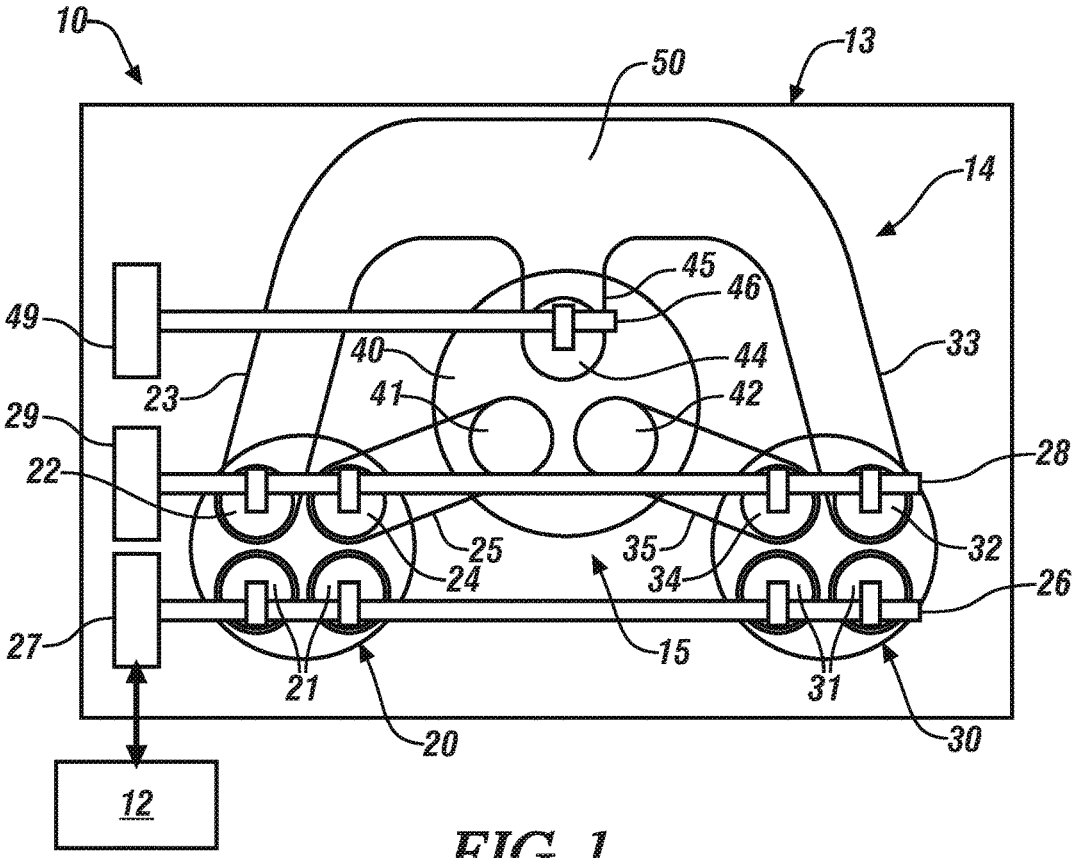
FIG. 1 schematically illustrates a cutaway top view of a head of a single crankshaft, dual expansion internal combustion engine, in accordance with the disclosure.

Referring to the drawings, wherein like reference numerals correspond to like or similar components throughout the several Figures, FIG. 1, consistent with embodiments disclosed herein, schematically illustrates a cutaway top view of a head of a single crankshaft, dual expansion internal combustion engine (engine) 10. The engine 10 may be disposed in a vehicle that may include, but not be limited to a mobile platform in the form of a commercial vehicle, industrial vehicle, agricultural vehicle, passenger vehicle, aircraft, watercraft, train, all-terrain vehicle, personal movement apparatus, robot and the like to accomplish the purposes of this disclosure.

The engine 10 includes an engine block 13 having a plurality of pistons that are slidably disposed in a corresponding plurality of cylinders, a head, a rotatable crankshaft, an intake manifold and an exhaust manifold 50. Combustion or pressure chambers are formed in each of the cylinders between the head and the pistons. The pistons are coupled to the crankshaft, and the combustion process generates pressure that exerts force upon the pistons that causes them to slide downward in the cylinders. The pistons move upwardly and downwardly in a reciprocating motion in concert to rotate the crankshaft.

The engine 10 includes one or a plurality of dual mode cylinder sets 15 that each include first and second power cylinders 20 and 30, respectively, and an expander cylinder 40.

The first power cylinder 20 provides a housing for a first piston (not shown), and a first combustion chamber is formed between the first power cylinder 20, the first piston and a portion of the head 14. The head 14 provides mounting structure for one or a plurality of intake valves 21, a first exhaust valve 22 and a second exhaust valve 24. The first exhaust valve 22 is fluidly coupled to a first exhaust runner 23 that is fluidly coupled to the exhaust manifold 50, and the second exhaust valve 24 is fluidly coupled to a second exhaust runner 25 that is fluidly coupled to a first inlet valve 41 of the expander cylinder 40.

The second power cylinder 30 provides a housing for a second piston (not shown), and a second combustion chamber is formed between the second power cylinder 30, the second piston and a portion of the head 14. The head 14 provides mounting structure for one or a plurality of intake valves 31, a first exhaust valve 32 and a second exhaust valve 34. The first exhaust valve 32 is fluidly coupled to a first exhaust runner 33 that is fluidly coupled to the exhaust manifold 50, and the second exhaust valve 34 is fluidly coupled to a second exhaust runner 35 that is fluidly coupled to a second inlet valve 42 of the expander cylinder 40. The second power cylinder 30 is arranged to be 360° out of phase with the first power cylinder 20, with regard to the four-stroke engine cycle.

The expander cylinder 40 provides a housing for an expander piston (not shown), and an expansion chamber is formed between the expander cylinder 40, the expander piston and a portion of the head 14. The head 14 provides mounting structure for the first and second inlet valves 41, 42 and an outlet valve 44. The outlet valve 44 is fluidly connected to the exhaust manifold 50 via a runner 45.

In one embodiment, a first camshaft 26 is rotatably disposed on the head 14 and configured to effect opening and closing of the intake valves 21 of the first power cylinder 20 and the intake valves 31 of the second power cylinder 30 in concert with rotation of the crankshaft. A first variable valve actuator 27 is disposed to interact with the crankshaft to control timing and magnitude of lift of the openings and closings of the intake valves 21, 31.

In one embodiment, a second camshaft 28 is rotatably disposed on the head 14 and configured to effect opening and closing of the first and second exhaust valves 22, 24 of the first power cylinder 20 and the first and second exhaust valves 32, 34 of the second power cylinder 30 in concert with rotation of the crankshaft. A second variable valve actuator 29 is disposed to interact with the crankshaft to individually control timing and magnitude of lift of the openings and closings of the aforementioned exhaust valves 22, 24, 32, 34.

In one embodiment, a third camshaft 46 is rotatably disposed on the head 14 and configured to effect opening and closing of the outlet valve 44 of the expander cylinder 40. A third variable valve actuator 49 is disposed to interact with the crankshaft to individually control timing of the opening and closing of the outlet valve 44.

The first and second variable valve actuators 27, 29 are configured to control and adjust openings and closings of the intake and exhaust valves in response to command signals from the engine controller 12. Controlling and adjusting openings and closings of the intake and exhaust valves includes controlling and adjusting camshaft phasing in relation to rotation of the crankshaft, thus linking openings and closings of the intake and exhaust valves to a rotational position of the crankshaft and a linear position of the pistons. Controlling and adjusting openings and closings of the intake and exhaust valves includes controlling and adjusting magnitude of valve lift to one of two or more discrete lift steps. In one embodiment, the second variable valve actuator 29 is configured to control the second camshaft 28 to selectively deactivate the exhaust valves 22, 24, 32, 34. In one embodiment, the second variable valve actuator 29 is configured to control the second camshaft 28 to activate only the second exhaust valves 24, 34 and completely deactivate the first exhaust valves 22, 32, thus effecting exhaust flow from the first and second power cylinders 20, 30 through the first and second inlet valves 41, 42 to the expander cylinder 40 through the second exhaust runners 25, 35. In one embodiment, the second variable valve actuator 29 is configured to control the second camshaft 28 to activate only the first exhaust valves 22, 32 and completely deactivate the second exhaust valves 24, 34, thus effecting exhaust flow from the first and second power cylinders 20, 30 through the first exhaust runners 23, 33 to the exhaust manifold 50.

The variable cam phasing mechanisms of the first and second variable valve actuators 27, 29 each preferably has a range of phasing authority of about 60°-90° of crank rotation, thus permitting the controller 12 to advance or retard opening and closing of one of intake and exhaust valve(s) relative to position of the piston for each of the power cylinders 20, 30. The range of phasing authority is defined and limited. The first and second variable valve actuators 27, 29 include camshaft position sensors to determine rotational positions, and can be actuated using one of electro-hydraulic, hydraulic, and electric control force, in response to respective control signals.

The engine 10 preferably employs a direct-injection fuel injection system including a plurality of high-pressure fuel injectors that are configured to directly inject a mass of fuel into the combustion chambers of the power cylinders 20, 30. The engine 10 may employ a spark-ignition system by which spark energy may be provided to a spark plug for igniting or assisting in igniting cylinder charges in each of the combustion chambers of the power cylinders 20, 30. The engine 10 is equipped with various sensing devices for monitoring engine operation, including, e.g., a crank sensor, a coolant temperature sensor, an in-cylinder combustion or pressure sensor, an exhaust gas sensor, etc.

The term "controller" and related terms such as control module, module, control, control unit, processor and similar terms refer to one or various combinations of Application Specific Integrated Circuit(s) (ASIC), electronic circuit(s), central processing unit(s), e.g., microprocessor(s) and associated non-transitory memory component(s) in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning and buffer circuitry and other components that can be accessed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms and similar terms mean controller-executable instruction sets including calibrations and look-up tables. Each controller executes control routine(s) to provide desired functions. Routines may be executed at regular intervals, for example each 100 microseconds during ongoing operation. Alternatively, routines may be executed in response to occurrence of a triggering event. Communication between controllers, and communication between controllers, actuators and/or sensors may be accomplished using a direct wired point-to-point link, a networked communication bus link, a wireless link or another suitable communication link.

Communication includes exchanging data signals in suitable form, including, for example, electrical signals via a conductive medium, electromagnetic signals via air, optical signals via optical waveguides, and the like. The data signals may include discrete, analog or digitized analog signals representing inputs from sensors, actuator commands, and communication between controllers. The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium.

The engine 10 is operable in an expansion mode and a bypass mode. When operating in the expansion mode, the openings and closings of the exhaust valves 22, 24, 32, 34 are controlled to channel flow of exhaust gases from the first and second power cylinders 20, 30 to the expander cylinder 40 to effect additional work therefrom prior to expulsion into the exhaust manifold 50. When operating in the bypass mode, the openings and closings of the exhaust valves 22, 24, 32, 34 are controlled to channel flow of exhaust gases from the first and second power cylinders 20, 30 directly to the exhaust manifold 50, and thus bypass the expander cylinder 40.

Figure 2:
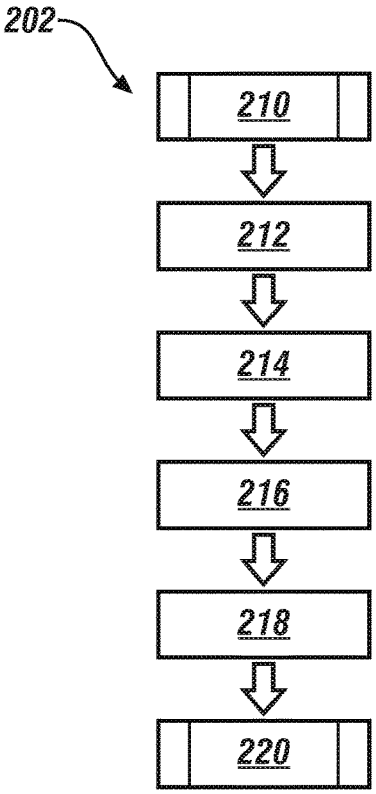
FIG. 2 schematically illustrates a first process that is associated with controlling operation of the engine to transition between operating in a bypass mode and operating an expansion mode, in accordance with the disclosure.
Figure 4:
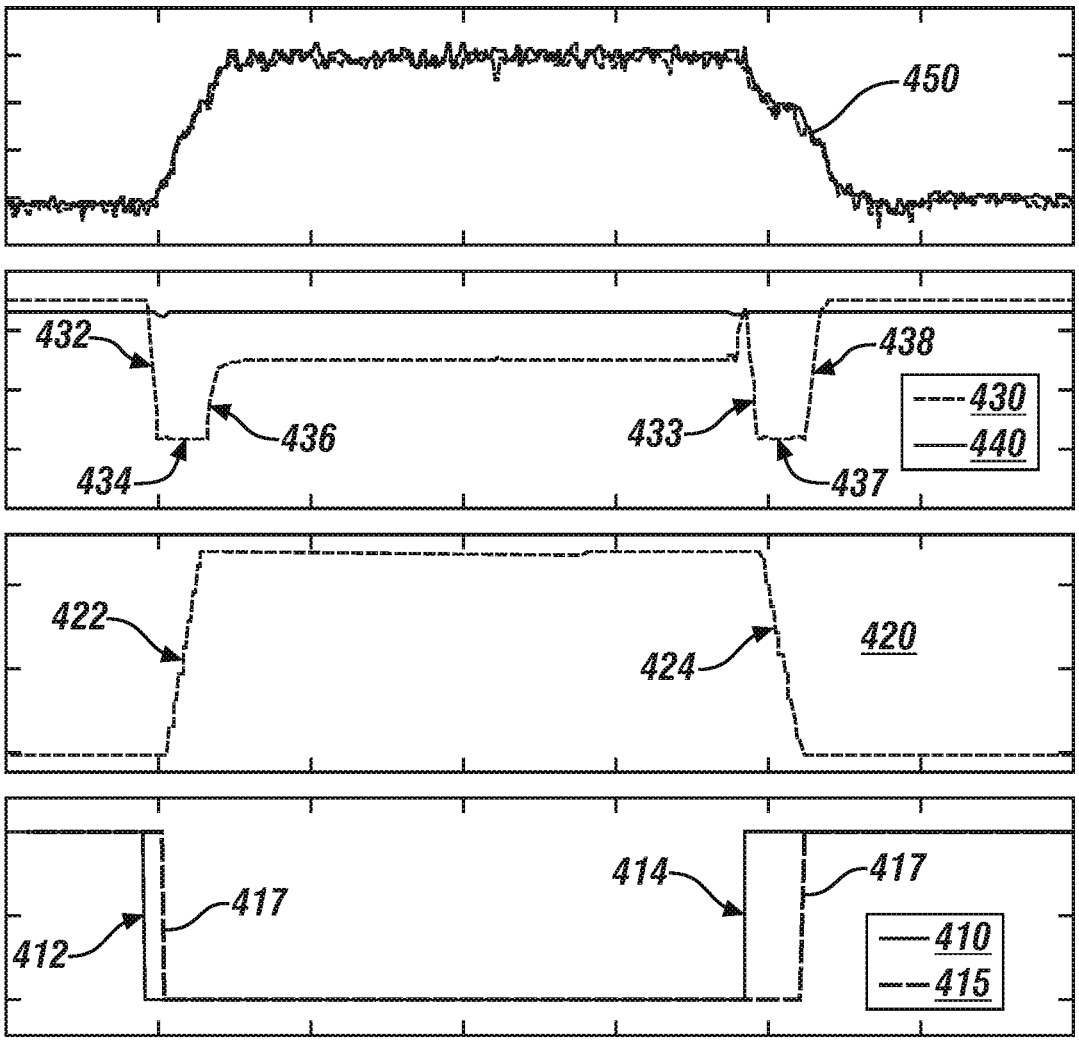
FIG. 4 graphically shows various engine operating parameters during execution of the first process that is described with reference to FIG. 2 and during execution of the second process that is described with regard to FIG. 3, in accordance with the disclosure.

Transitioning operation of the engine 10 between operating in the bypass mode 210 and operating in the expansion mode 220 is advantageously effected with reference to a first process 202, which is illustrated with reference to FIG. 2. This operation is shown graphically with reference to FIG. 4, with continued reference to the elements described with reference to FIG. 1. FIG. 4 graphically shows a bypass request 410, a commanded position for the outlet valve 44 (CAMO) 420, a commanded position for the intake valves 21, 31 (CAMI) 430, a commanded position for the first and second exhaust valves 22, 24, 32, 34 (CAME) 440, and a corresponding engine load (IMEP) 450, all in relation to time, as indicated on the coincident horizontal axes.

Operation in the bypass mode is indicated by element 210, and includes engine operation wherein cam timing for controlling the openings and closings of the exhaust valves 22, 24, 32, 34 are controlled to channel flow of exhaust gases from the first and second power cylinders 20, 30 directly to the exhaust manifold 50. The respective first exhaust valves 22, 32 are closed, and the respective second exhaust valves 24, 34 are opened at pertinent times to effect flow of exhaust gas to the exhaust manifold 50 and avoid flow of exhaust gas to the expander cylinder 40.

Upon requesting a transition to the expansion mode 220, openings of the intake valves 21, 31 are retarded to a late-intake-valve closing (LIVC) state (212), which can be accomplished by controlling the first variable valve actuator 27 to control and adjust openings and closings of the intake valves 21, 31 in response to command signals from the engine controller 12, including controlling and adjusting camshaft phasing in relation to rotation of the crankshaft and/or controlling and adjusting magnitude of valve lift to a low-lift step. A request to transition from the bypass mode 210 to the expansion mode 220 is depicted in FIG. 4 by the bypass request 410, which includes an expansion mode request 412 and a valve command 415 to the second variable valve actuator 29 to activate the first exhaust valves and deactivate the second exhaust valves. The transition to the LIVC state is depicted with reference to portion 432 of CAMI 430.

Upon achieving the LIVC state for the intake valves 21, 31, the expansion piston 40 is engaged (214). This includes respective first exhaust valves 22, 32 being opened at pertinent times to effect flow of exhaust gas to the expander cylinder 40 and the respective second exhaust valves 24, 34 being closed to avoid flow of exhaust gas to the exhaust manifold 50, followed by advancing opening of the outlet valve 44 by controlling operation of the third variable valve actuator 49 to control timing of the opening and closing of the outlet valve 44 (216). FIG. 4 depicts advancing opening of the outlet valve 44 with reference to portion 422 of CAMO 420. This process may take several engine cycles to accomplish, during which time the intake valves 21, 31 are controlled to the LIVC state, which is depicted with reference to portion 434 of CAMI 430 in FIG. 4.

When the opening timing of the outlet valve 44 has been advanced to its maximum state, the first variable valve activation system 27 is controlled to control the intake valve camshaft 26 to a desired position that is associated with engine operation in the expansion mode (218), and engine operation in the expansion mode 220 commences. This is depicted with reference to portion 436 of CAMI 430 in FIG. 4.

During the transition from the bypass mode 210 to the expansion mode 220, the IMEP 450 steadily increases without interruption.

Figure 3:
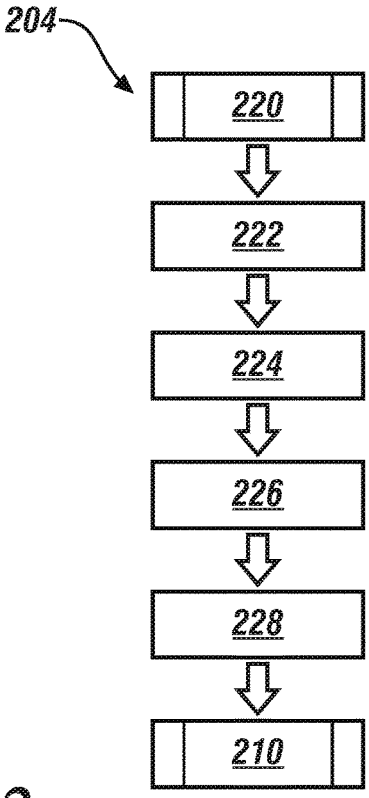
FIG. 3 schematically illustrates a second process that is associated with controlling operation of the engine to transition between operating in the expansion mode and operating in the bypass mode, in accordance with the disclosure.

Transitioning operation of the engine 10 between operating in the expansion mode 220 and operating in the bypass mode 210 is advantageously effected with reference to a second process 204, which is illustrated with reference to FIG. 3. This operation is shown graphically with reference to FIG. 4, with continued reference to the elements described with reference to FIG. 1.

Operation in the bypass mode is indicated by element 202, and includes engine operation wherein cam timing for controlling the openings and closings of the exhaust valves 22, 24, 32, 34 are controlled to channel flow of exhaust gases from the first and second power cylinders 20, 30 to the expansion cylinder 40.

Upon requesting a transition to the bypass mode 210, openings of the intake valves 21, 31 are retarded to the late-intake-valve closing (LIVC) state (222), which can be accomplished by controlling the first variable valve actuator 27 to control and adjust openings and closings of the intake valves 21, 31 in response to command signals from the engine controller 12, including controlling and adjusting camshaft phasing in relation to rotation of the crankshaft and/or controlling and adjusting magnitude of valve lift to a low-lift step. A request to transition from the expansion mode 220 to the bypass mode 210 is depicted in FIG. 4 by the bypass request 410, which includes a bypass mode request 414 and a valve command 417 to the second variable valve actuator 29 to deactivate the first exhaust valves 22, 32 and activate the second exhaust valves 24, 34. The transition to the LIVC state is depicted with reference to portion 433 of CAMI 430.

Upon achieving the LIVC state for the intake valves 21, 31, the opening of the outlet valve 44 is retarded by controlling operation of the third variable valve actuator 49 to control timing of the opening and closing of the outlet valve 44 (224), followed by respective first exhaust valves 22, 32 are opened at pertinent times to effect flow of exhaust gas to the expander cylinder 40 and the respective second exhaust valves 24, 34 are closed to avoid flow of exhaust gas to the exhaust manifold 50. FIG. 4 depicts retarding opening of the outlet valve 44 with reference to portion 424 of CAMO 420. This process may take several engine cycles to accomplish, during which time the intake valves 21, 31 are controlled to the LIVC state, which is depicted with reference to portion 437 of CAMI 430 in FIG. 4.

When the opening timing of the outlet valve 44 has been retarded to its minimum state, the expansion cylinder 40 is disengaged (226) and the first variable valve activation system 27 is controlled to control the intake valve camshaft 26 to a desired position that is associated with engine operation in the bypass mode (228), and engine operation in the bypass mode 210 commences. This is depicted with reference to portion 438 of CAMI 430 in FIG. 4. During the transition from the bypass mode 210 to the expansion mode 220, the IMEP 450 steadily decreases without interruption.

Figure 5:
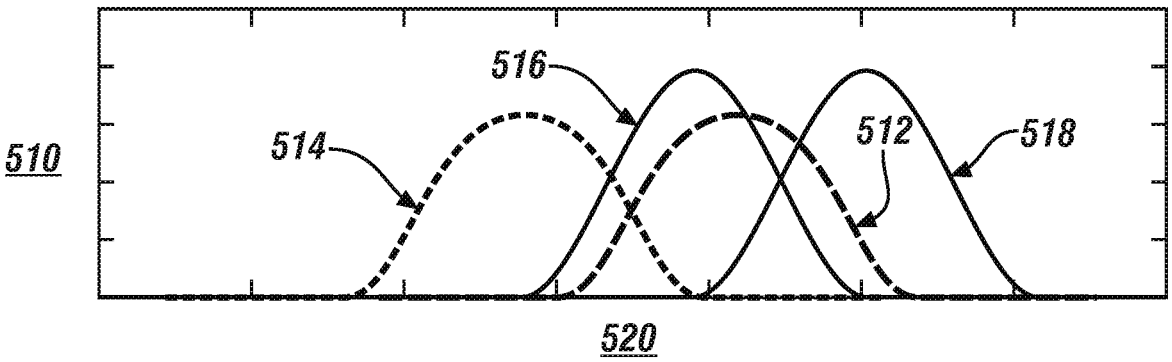
FIG. 5 graphically shows a valve opening timing for an embodiment of the engine, wherein timings and magnitudes of valve lift for intake, exhaust and outlet valves are depicted on the vertical axis in relation to engine crank angle, in accordance with the disclosure.

FIG. 5 graphically shows a valve opening timing for an embodiment of the engine 10 described hereinabove, wherein magnitude of valve lift 510 is depicted on the vertical axis in relation to crank angle 520, which is depicted on the horizontal axis and includes a top-dead-center (TDC) position. Relevant valve openings including intake valve opening 512, exhaust valve opening 514, and outlet valve openings, including a first valve opening 516 that is associated with a maximum advanced state and a second valve opening 518 that is associated with a maximum retarded state. The first valve opening 516 that is associated with the maximum advanced state depicts an optimal outlet valve position for improving fuel economy when the expander cylinder is engaged. The second valve opening 518 that is associated with the maximum retarded state depicts an optimal outlet valve position for achieving minimum pumping loss when the expander cylinder is bypassed.

The concepts described herein provide sequential control of multiple actuators to achieve a seamless engagement and dis-engagement of the expander cylinder for smooth load transients in the engine 10.

The flowchart and block diagrams in the flow diagrams illustrate the architecture, functionality, and operation of possible implementations of systems, methods, and computer program products according to various embodiments of the present disclosure. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable medium that can direct a controller or other programmable data processing apparatus to function in a particular manner, such that the instructions stored in the computer-readable medium produce an article of manufacture including instructions to implement the function/act specified in the flowchart and/or block diagram block or blocks.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

What is claimed is:

1. A method for controlling an internal combustion engine including first and second power cylinders and an expander cylinder, wherein the internal combustion engine is configured to operate in an expander mode, including exhaust flow from the first and second power cylinders being fluidly coupled to the expander cylinder, and wherein the internal combustion engine is configured to operate in a bypass mode, including exhaust flow from the first and second power cylinders being fluidly decoupled from the expander cylinder; the method comprising:

commanding a transition from the bypass mode to the expander mode during engine operation;

retarding openings of intake valves of the first and second power cylinders to a Late Intake Valve Closing ("LIVC") position;

controlling exhaust valves of the power cylinders to effect fluid flow to the expander cylinder;

advancing opening of an outlet valve of the expander cylinder to a maximum advanced state; and controlling, via a controller, the openings of the intake valves of the first and second power cylinders to desired positions associated with engine operation in the expander mode.

2. The method of claim 1, wherein controlling exhaust valves of the power cylinders to effect fluid flow to the expander cylinder comprises activating first exhaust valves associated with the first and second power cylinders to couple fluid flow to the expander cylinder and deactivating second exhaust valves associated with the first and second power cylinders to decouple fluid flow to an exhaust manifold.

3. The method of claim 1, comprising controlling the exhaust valves of the power cylinders to effect fluid flow to the expander cylinder after the openings of the intake valves of the first and second power cylinders have been retarded to the LIVC position.

4. The method of claim 1, comprising advancing opening of the outlet valve of the expander cylinder to the maximum advanced state after the exhaust valves of the power cylinders have been controlled to effect fluid flow to the expander cylinder.

5. The method of claim 1, comprising controlling the openings of the intake valves of the first and second power cylinders to desired positions associated with engine operation in the expander mode after the opening of the outlet valve of the expander cylinder has been advanced to the maximum advanced state.

6. The method of claim 1, further comprising:

commanding a transition from the expander mode to the bypass mode during engine operation;

retarding openings of the intake valves of the first and second power cylinders to the LIVC position;

retarding the outlet valve of the expander cylinder to a maximum retarded state;

controlling exhaust valves of the power cylinders to discontinue fluid flow to the expander cylinder; and controlling, via the controller, the openings of the intake valves of the first and second power cylinders to desired positions associated with engine operation in the bypass mode.

7. The method of claim 6, comprising retarding the outlet valve of the expander cylinder to the maximum retarded state after the openings of the intake valves of the first and second power cylinders have been retarded to the LIVC position.

8. The method of claim 6, comprising controlling exhaust valves of the power cylinders to discontinue fluid flow to the expander cylinder after the outlet valve of the expander cylinder has been retarded to the maximum retarded state.

9. The method of claim 6, comprising controlling the openings of the intake valves of the first and second power cylinders to the desired positions associated with engine operation in the bypass mode after the exhaust valves of the power cylinders have been controlled to discontinue fluid flow to the expander cylinder.

10. The method of claim 6, wherein controlling exhaust valves of the power cylinders to discontinue fluid flow to the expander cylinder comprises deactivating first exhaust valves associated with the first and second power cylinders to decouple fluid flow to the expander cylinder and activating second exhaust valves associated with the first and second power cylinders to couple fluid flow to an exhaust manifold.

11. An internal combustion engine, comprising:

first and second power cylinders, each including:

an intake valve;

a first exhaust valve fluidly coupled to a first runner;

a second exhaust valve fluidly coupled to a second runner that is fluidly coupled to an exhaust manifold;

a first variable valve activation system coupled to the intake valves;

a second variable valve activation system coupled to the first and second exhaust valves and configured to independently control activations of the first exhaust valves and the second exhaust valves;

an expander cylinder, including:

an inlet valve fluidly coupled to the first runners;

an outlet valve fluidly coupled to the exhaust manifold;

a third variable valve activation system coupled to the outlet valve;

a controller, operatively connected to the first, second and third variable valve activation systems, the controller including an instruction set executable to command a transition from a bypass mode to an expander mode during engine operation, including:

control the first variable valve activation system to retard each of the intake valves to a Late Intake Valve Closing ("LIVC") position;

control the second variable valve activation system to engage the expander cylinder; and then control the third variable valve activation system to advance the outlet valve to a maximum advanced state; and then control the first variable valve activation system to control the intake valves to desired positions associated with engine operation in the expander mode.

12. The internal combustion engine of claim 11, wherein the instruction set executable to control the second variable valve activation system to engage the expander cylinder comprises the instruction set executable to control the second variable valve activation system to activate the first exhaust valves and deactivate the second exhaust valves.

13. The internal combustion engine of claim 11, further comprising the controller including an instruction set executable to command a transition from the expander mode to the bypass mode during engine operation, including:

control the first variable valve activation system to retard the intake valves to the LIVC position; and then, control the third variable valve activation system to retard the outlet valve to a maximum retard state; and then, control the second variable valve activation system to disengage the expander cylinder; and then, control the first variable valve activation system to control the intake valves to a desired position associated with engine operation in the bypass mode.

14. The internal combustion engine of claim 13, wherein the instruction set executable to control the second variable valve activation system to disengage the expander cylinder comprises the instruction set executable to control the second variable valve activation system to deactivate the first exhaust valves and activate the second exhaust valves.

15. A method for controlling an internal combustion engine including first and second power cylinders and an expander cylinder, wherein the internal combustion engine is configured to operate in an expander mode, including exhaust flow from the first and second power cylinders being fluidly coupled to the expander cylinder, and wherein the internal combustion engine is configured to operate in a bypass mode, including exhaust flow from the first and second power cylinders being fluidly decoupled from the expander cylinder; the method comprising:

commanding a transition from the expander mode to the bypass mode during engine operation;

retarding openings of the intake valves of the first and second power cylinders to a Late Intake Valve Closing ("LIVC") position;

retarding the outlet valve of the expander cylinder to a maximum retarded state;

controlling exhaust valves of the power cylinders to discontinue fluid flow to the expander cylinder;

controlling, via a controller, the openings of the intake valves of the first and second power cylinders to desired positions associated with engine operation in the bypass mode; and operating the engine in the bypass mode.

16. The method of claim 15, further comprising:

commanding a transition from the bypass mode to the expander mode during engine operation;

retarding openings of intake valves of the first and second power cylinders to the LIVC position;

controlling exhaust valves of the power cylinders to effect fluid flow to the expander cylinder;

advancing opening of an outlet valve of the expander cylinder to a maximum advanced state;

controlling, via the controller, the openings of the intake valves of the first and second power cylinders to desired positions associated with engine operation in the expander mode; and operating the engine in the expander mode.

* * * * *